US007628347B2

(12) United States Patent
Frangenberg et al.

(10) Patent No.: US 7,628,347 B2
(45) Date of Patent: Dec. 8, 2009

(54) DOUBLE-ROLL MACHINE FOR COMMINUTING A BED OF MATERIAL

(75) Inventors: Meinhard Frangenberg, Kürten-Engeldorf (DE); Erich Sommer, Köln (DE); Jörg Schnepper, Köln (DE); Christian Splinter, Pulheim (DE); Alexander Hagedorn, Pullheim (DE)

(73) Assignee: KHD Humboldt Wedag GmbH, Köln (DE)

( * ) Notice: Subject to any disclaimer, the term of this patent is extended or adjusted under 35 U.S.C. 154(b) by 54 days.

(21) Appl. No.: 12/158,086

(22) PCT Filed: Dec. 19, 2006

(86) PCT No.: PCT/EP2006/012219

§ 371 (c)(1),
(2), (4) Date: Jun. 19, 2008

(87) PCT Pub. No.: WO2007/079926

PCT Pub. Date: Jul. 19, 2007

(65) Prior Publication Data

US 2008/0296424 A1 Dec. 4, 2008

(30) Foreign Application Priority Data

Dec. 21, 2005 (DE) ..... 10 2005 061 085

(51) Int. Cl.
*B02C 7/14* (2006.01)
*B02C 18/30* (2006.01)
*B21B 31/00* (2006.01)

(52) U.S. Cl. ..... 241/231; 241/285.2; 72/237

(58) Field of Classification Search ..... 241/231, 241/235, 285.2; 72/237–239
See application file for complete search history.

(56) References Cited

U.S. PATENT DOCUMENTS

| | | | | |
|---|---|---|---|---|
| 2,880,897 | A | 4/1959 | Wilms et al. | |
| 3,376,724 | A | 4/1968 | Wolfendale et al. | |
| 4,905,910 | A | 3/1990 | Wuestner | |
| 5,780,088 | A | 7/1998 | Zittel | |
| 7,363,793 | B2 * | 4/2008 | Benner | 72/238 |

FOREIGN PATENT DOCUMENTS

| | | |
|---|---|---|
| DE | 12 92 578 | 4/1969 |
| DE | 37 31 934 | 4/1989 |

* cited by examiner

*Primary Examiner*—Faye Francis
(74) *Attorney, Agent, or Firm*—Greer, Burns & Crain Ltd

(57) ABSTRACT

A two-roll machine, in particular a roll press, for interparticle comminution of granular material with two rotatably mounted, counter-rotating driven rolls separated from one another by a roll gap. Drive journals of the roll's shaft-mounted gearboxes are shaft-mounted as step-down planetary gear units. A machine table with a table platen is arranged under each of the shaft-mounted gearboxes that can move back and forth parallel to the roll shaft in at least one direction, and three vertically and horizontally adjustable supporting rests arranged in a triangle are arranged on the table platen on which the respective shaft-mounted gearbox can be supported offset-free and aligned with the roll shaft drive journal during its installation and removal.

14 Claims, 2 Drawing Sheets

DOUBLE-ROLL MACHINE FOR COMMINUTING A BED OF MATERIAL

BACKGROUND OF THE INVENTION

The invention relates to a two-roll machine for high-pressure crushing of granular material, in particular a roll press for interparticle comminution or compacting/briquetting, with two counter-rotating driven rolls mounted rotatably in bearing housings and separated from one another by a roll gap. Mounted on the roll shaft drive journal of each of the rolls extending out of the machine frame as a shaft-mounted gearbox is a planetary gear unit whose input stage is driven by a drive motor.

On roll mills for so-called interparticle comminution, the individual pieces or particles of the material to be ground drawn into the roll gap by friction, e.g. cement raw material, cement clinker, ores or similar materials, are pressed together and mutually comminuted in a material bed, in other words in a material pile pressed together between the two roll surfaces under high pressure, whereby one also speaks of a roll press instead of a roll mill. On such known roll presses, cf. e.g. brochure "Rollenpressen" (Roll Presses) No. 2-300d of KHD Humboldt Wedag AG dated September 1994, one of the two rolls is designed as a fixed roll that is supported by means of its bearing housing against end walls of the machine frame, while the other roll designed as a floating roll is supported via its bearing housing on hydraulic cylinders with which the roll pressure force is applied.

For the drive of such roll presses it is common to allow two roll shaft drive journals to extend out of the machine frame, on each of which a planetary gear unit (epicyclic gear unit) is shaft-mounted, and whose input stage is driven by an electric motor, and in the case of large roll presses via a universal-joint shaft and a coupling. It is common here to make the connection between the hollow shaft on the output side of the gear unit and the drive journal of the roll press rolls by means of a so-called shrink disc connection that has an externally clamping, hydraulically actuated clamping set with clamping rings that is suitable as a backlash-free non-positive connection for the transmission of even very high torques.

The load of the heavy shaft-mounted gearbox is not supported on the ground; the gearboxes are over-mounted on the drive journal. Until now, rope cranes have been generally used for installation and removal of the shaft-mounted gearboxes. During installation and removal, the drive journal and the attached shaft-mounted gearbox must be aligned on one axis and exactly positioned horizontally and vertically. Such levelling is difficult to achieve, particularly as the lifting point of the gear unit is not at its center of gravity, so that the danger cannot be ruled out that if the shaft-mounted gearbox is not exactly positioned, damage can be caused to the surface of the drive journals and to the gearbox hollow shafts during installation and removal with pushing on and pulling off of the gear unit and hydraulic actuation of the shrink disc connection. The installation and removal of the shaft-mounted gearboxes on roll presses is not a one-off operation, because for reasons of repair (e.g. with worn rolls), the operators of such roll presses need to be able to remove and reinstall these rolls in the simplest and fastest possible manner, with the shaft-mounted gearboxes having to be removed from their drive journals.

SUMMARY OF THE INVENTION

The object of the invention is to design a two-roll machine, in particular a roll press of the above-mentioned type, in such a way that the installation and removal of the rolls and hence the roll change can be carried out even more simply, quickly and safely.

In the two-roll machine according to the invention, in particular a roll press for interparticle comminution, a machine table with a table platen that can move back and forth parallel to the roll shaft in at least one direction is located underneath the shaft-mounted gearboxes over-mounted on the two drive journals as step-down gearboxes. Located on the table platen are advantageously three vertically and horizontally adjustable supporting rests arranged in a triangle on which the respective shaft-mounted gearbox is supported during its installation and removal and can thereby be positioned vertically and horizontally so that the hollow shaft axis on the output side of the shaft-mounted gearbox is aligned precisely without offset with the axis of the drive journal, a fact that is of great importance for a trouble-free hydraulically actuated shrink disc connection between the drive journal and the shaft-mounted gearbox and which considerably simplifies its installation and removal and hence also a roll change.

According to a further feature of the invention, the three supporting rests arranged on the table platen that support the high load of the gear unit in a statically determined manner can be hydraulic cylinders for vertical alignment of the respective supported shaft-mounted gearbox, whereby the foot section of the hydraulic cylinders can be connected e.g. to a simple screw jack system for horizontal adjustment on the table platen, in order to be able to adjust the supporting rests e.g. also in a transverse direction relative to the drive journal.

The table platen can have a sliding guide on the machine table on rollerways or even slideways. In order to support the removal/installation of the respective shaft-mounted gearbox from/on the drive journal, a hydraulic cylinder can be arranged on both sides of the drive journal and parallel thereto between the machine frame and the shaft-mounted gearbox that provides the force necessary for removal/installation of the gear unit symmetrically to the aligned gearbox.

BRIEF DESCRIPTION OF THE DRAWINGS

The invention and its further features and advantages are described in greater detail by reference to the illustrative embodiments shown schematically in the figures.

DETAILED DESCRIPTION OF THE DRAWINGS

Figure 1:
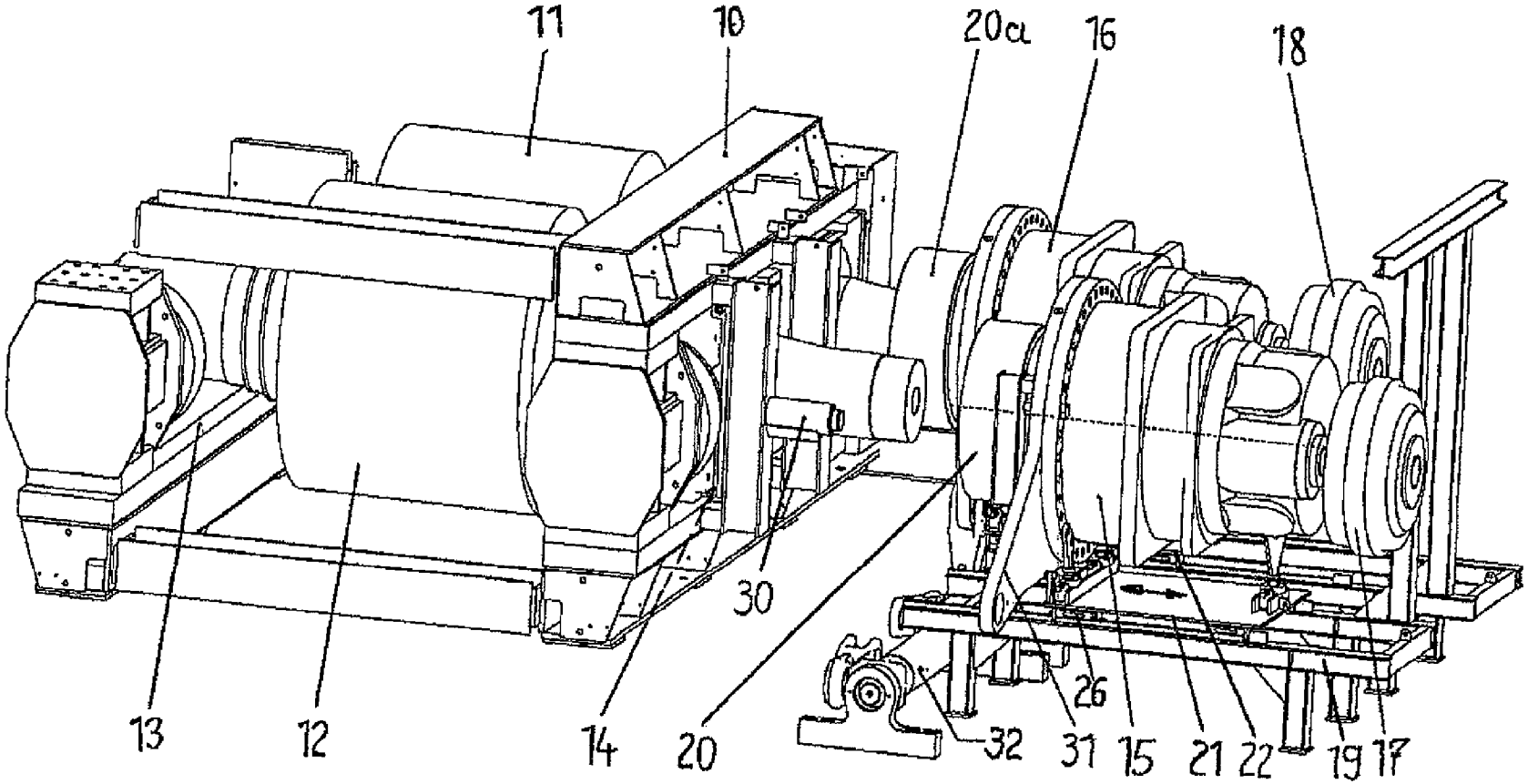
FIG. 1: shows in perspective view a roll press for pressure comminution of granular material, with an assembly table to simplify installation and removal of the shaft-mounted gearboxes.

According to FIG. 1, the roll press has a machine frame 10 that in the drawing is partially dismantled, in which two counter-rotating rolls 11, 12 are rotatably mounted and which between them form a roll gap, and of which the one roll, e.g. the rear roll in FIG. 1 is designed as a fixed roll 11 and the other roll as a floating roll 12. Both rolls have bearing shafts that are supported in roller bearings, in particular in cylindrical roller bearings, which in turn are located in bearing housings. While the fixed roll 11 is supported directly on the machine frame side sections with its two bearing housings and rests on two brackets 13, 14 of the machine frame 10, the floating roll 12 also rests with its bearing housings on the slideways of these two spaced frame brackets 13 and 14 where it can slide back and forth transversely to the roll gap with its bearing housings by means of slide plates. The bearing housings of the floating roll 12 are supported on hydraulic cylinders via which the roll pressure force for pressurising the material to be comminuted located in the roll gap is applied, with the hydraulic cylinders in turn being supported on machine frame side sections. The rolls together with their two bearing housings each form an assembly unit during installation and removal.

The two roll shaft drive journals onto each of which a planetary gear unit (epicyclic gear unit) as a step-down gear unit can be pushed as a shaft-mounted gearbox 15, 16 with a coupling 17, 18 extend out of the bearing housings on the right-hand side of the machine frame 10. The couplings 17, 18 are each connected by means of universal-joint shafts (not illustrated) to an electric motor for the rotational drive of the rolls.

The backlash-free, non-positive connections between the hollow shaft on the output side of the shaft-mounted gearboxes 15, 16 and the roll drive journal each consist very advantageously of a shrink disc 20 or 20*a* with an externally clamping, hydraulically actuated clamping set with clamping rings. This shrink disc connection that can transmit very high torques must be made and separated again during the installation/removal of the rolls and/or their replacement. The pushing and pulling of the shaft-mounted gearboxes 15, 16 onto and off their drive journals on which the shaft-mounted gearboxes are over-mounted, demands a precisely aligned, offset-free positioning of the drive journal and gearbox hollow shaft. As can be seen from FIGS. 1 and 2, a machine table 19 with a mounted table platen is arranged underneath each of the shaft-mounted gearboxes 15, 16 for this purpose, namely the table platen 21 for the gearbox 15 and the adjacent table platen 22 for the adjacent gearbox 16. The table platen 21 and also the adjacent table platen 22 can move back and forth at least in one direction parallel to the roll shaft on the machine table 19. According to FIG. 1, the shaft-mounted gearbox 15 has just reached a parking position where it is supported on the retracted table platen 21 with the shrink disc connection separated and the universal-joint shaft disconnected, while on the adjacent shaft-mounted gearbox 16 the shrink disc connection 20*a* has not yet been separated.

Figure 2:
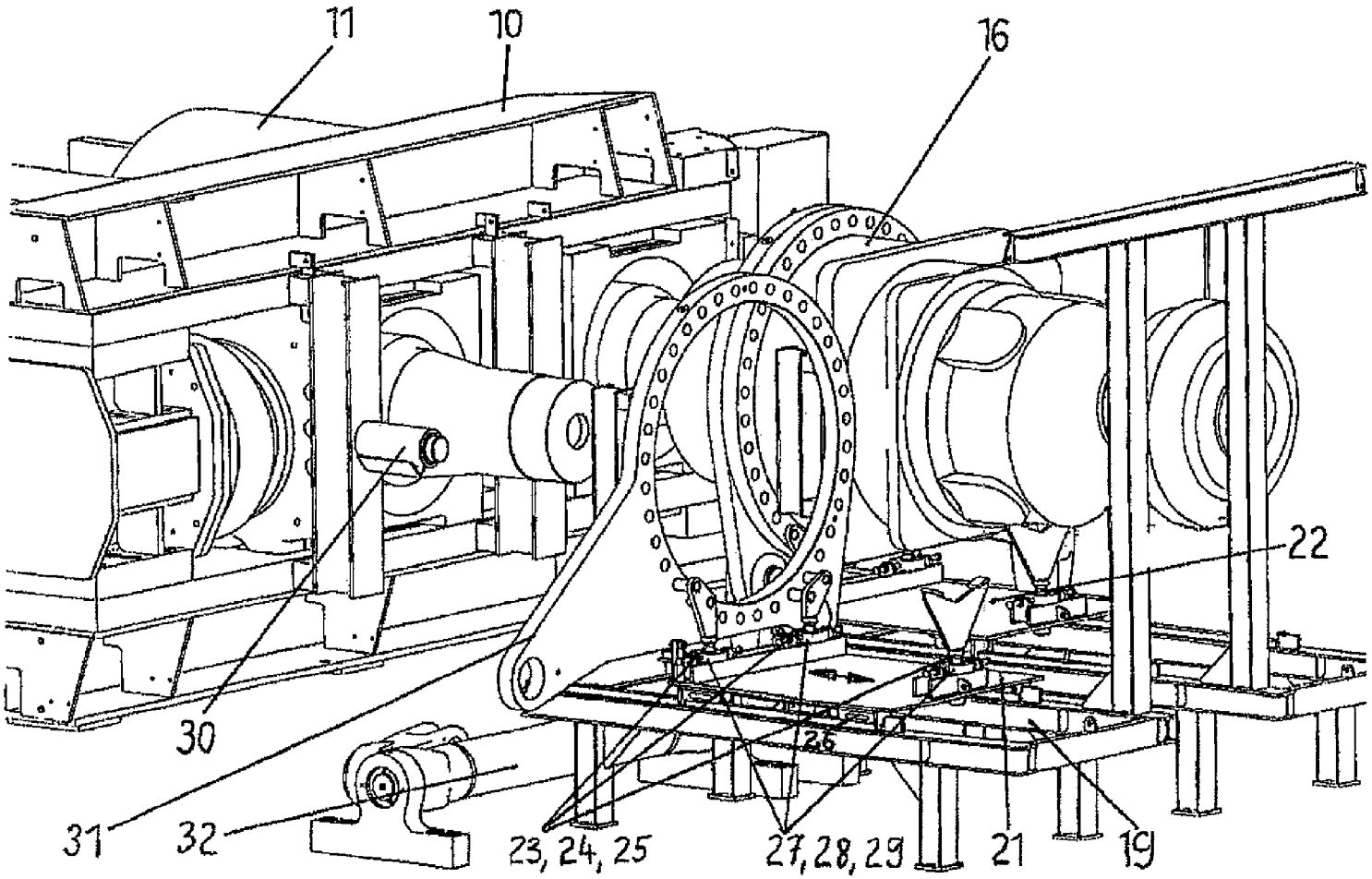
FIG. 2: shows in enlarged form from FIG. 1 also in perspective view a table platen that can move on the machine table with three adjustable rests arranged thereon for alignment of the heavy shaft-mounted gearbox to be supported thereon during its installation/removal.

FIG. 2 in particular shows clearly that for aligned adjustment of each shaft-mounted gearbox on the table platen 21, and also on the adjacent table platen 22, there are three vertically and horizontally adjustable supporting rests 23, 24, 25 arranged in a triangle on which the respective shaft-mounted gearbox 15 or 16 is supported aligned and adjusted offset-free during its installation and removal. After adjustment of the shaft-mounted gearbox 15, the table platen 21 with the supported shaft-mounted gearbox is moved and the shrink disc connection 20 or 20*a* is clamped hydraulically during gearbox installation and relieved hydraulically during gearbox removal. The table platen 21, 22 advantageously has a sliding guide on the machine table 19 by means of rollways 26. The three supporting rests 23, 24, 25 arranged on the table platen 21 for vertical adjustment of the respective supported shaft-mounted gearbox 15 or 16 are flat hydraulic cylinders whose foot sections are each connected for the sake of simplicity to a screw jack system 27, 28, 29 for horizontal adjustment on the table platen 21.

As can also be seen from the figures, a hydraulic cylinder 30 can be arranged on both sides of the drive journal of the left-hand roll, but also of the right-hand roll, and parallel thereto between the machine frame and the shaft-mounted gearbox 15 or 16 to support the pulling/pushing of the respective shaft-mounted gearbox 15, 16 off/onto the drive journal. Furthermore, the figures also show the arm of the torque strut 31 by means of which the restoring torque (reaction moment) is absorbed and transmitted into the stationary torque strut section 32 on each shaft-mounted gearbox 15, 16.

Before pulling the respective shaft-mounted gearbox 15, 16 from the drive journal, the connection between the torque strut 31 of the shaft-mounted gearbox 15 or 16 and the stationary torque strut section 32 is separated. During removal the gearboxes are moved in the direction of the disconnected universal-joint shaft. In the removed and retracted state, the shaft-mounted gearboxes 15 and 16 remain resting on their table platen 21 or 22, i.e. the gearboxes do not have to be lifted away during roll changing.

The invention can also be applied where another separable connection such as a flange connection, etc. is used instead of a shrink disc connection for connection of drive journal and shaft-mounted gearbox.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A two-roll machine for high-pressure crushing of granular material, with two counter-rotating driven rolls, with roll shafts mounted rotatably in bearing housings and separated from one another by a roll gap, wherein a planetary gear unit whose input stage is driven by a drive motor is mounted on a roll shaft drive journal of each of the rolls extending out of the machine frame as a shaft-mounted gearbox, comprising:

a machine table with a table platen that can move back and forth parallel to the roll shaft in at least one direction being located underneath the shaft-mounted gearboxes, three vertically and horizontally adjustable supporting rests being arranged in a triangle on the table platen on which the respective shaft-mounted gearbox is supported offset-free during its installation and removal, and hydraulic clamps arranged between the roll shaft drive journal and an output side of the gearbox such that after offset-free alignment and adjustment of the shaft-mounted gearbox, the table platen with the supported shaft-mounted gearbox is moved and the connection between the roll shaft drive journal and the gearbox output side is clamped hydraulically during gearbox installation and relieved hydraulically during gearbox removal.

2. The two-roll machine according to claim 1, wherein a separable connection between the roll shaft drive journal and the hollow shaft on the output side of the shaft-mounted gearbox is a non-positive shrink disc connection.

3. The two-roll machine according to claim 1, wherein the table platen on the machine table has a sliding guide which is one of rollerways and slideways.

4. The two-roll machine according to claim 3, wherein the slideways are formed of Teflon-coated chrome steel.

5. The two-roll machine according to claim 1, wherein a hydraulic cylinder is arranged on both sides of the drive journal and parallel thereto between the machine frame and the shaft-mounted gearbox to support the pulling/pushing of the respective shaft-mounted gearbox off/onto the drive journal.

6. The two-roll machine according to claim 1, wherein the three supporting rests arranged on the table platen for vertical adjustment of the respective supported shaft-mounted gearbox are hydraulic cylinders having a foot section which is connected to a screw jack system for horizontal adjustment on the table platen.

7. The two-roll machine according to claim 1, which is arranged and constructed such that before pulling the shaft-mounted gearbox off the drive journal, a connection between a torque strut of the shaft-mounted gear box and a stationary torque strut section can be separated.

8. A two-roll machine for high-pressure crushing of granular material, comprising:

two counter-rotating driven rolls, the rolls having roll shafts mounted rotatably in bearing housings and separated from one another by a roll gap, a planetary gear unit whose input stage is driven by a drive motor being mounted on a roll shaft drive journal of each of the rolls extending out of the machine frame as a shaft-mounted gearbox, a machine table with a table platen that can move back and forth parallel to the roll shaft in at least one direction being located underneath the shaft-mounted gearboxes, three vertically and horizontally adjustable supporting rests being arranged in a triangle on the table platen on which the respective shaft-mounted gearbox is supported offset-free during its installation and removal, and hydraulic clamps arranged between the roll shaft drive journal and an output side of the gearbox such that after offset-free alignment and adjustment of the shaft-mounted gearbox, the table platen with the supported shaft-mounted gearbox is moved and the connection between the roll shaft drive journal and the gearbox output side is clamped hydraulically during gearbox installation and relieved hydraulically during gearbox removal.

9. The two-roll machine according to claim 8, wherein a separable connection between the roll shaft drive journal and a hollow shaft on the output side of the shaft-mounted gearbox is a non-positive shrink disc connection.

10. The two-roll machine according to claim 8, wherein the table platen on the machine table has a sliding guide which is one of rollerways and slideways.

11. The two-roll machine according to claim 10, wherein the slideways are formed of Teflon-coated chrome steel.

12. The two-roll machine according to claim 8, wherein a hydraulic cylinder is arranged on both sides of the drive journal and parallel thereto between the machine frame and the shaft-mounted gearbox to support the pulling/pushing of the respective shaft-mounted gearbox off/onto the drive journal.

13. The two-roll machine according to claim 8, wherein the three supporting rests arranged on the table platen for vertical adjustment of the respective supported shaft-mounted gearbox are hydraulic cylinders having a foot section which is connected to a screw jack system for horizontal adjustment on the table platen.

14. The two-roll machine according to claim 8, which is arranged and constructed such that before pulling the shaft-mounted gearbox off the drive journal, a connection between a torque strut of the shaft-mounted gear box and a stationary torque strut section can be separated.

* * * * *